US005785175A

United States Patent [19]

Cholsaipant

[11] Patent Number: 5,785,175

[45] Date of Patent: Jul. 28, 1998

[54] FLEXIBLE BULK BAG WITH IMPROVED BASE

[76] Inventor: Natthi Cholsaipant, 134 Moo 7 Suan Luang Ruam Jai Road, Suan Luang Kratoomban, Samutsacorn 74110, Thailand

[21] Appl. No.: 694,997

[22] Filed: Aug. 9, 1996

[30] Foreign Application Priority Data

Jun. 4, 1996 [AU] Australia ..... 54741/96

[51] Int. Cl.[6] ..... B65D 33/02

[52] U.S. Cl. ..... 206/386; 383/119; 383/121.1

[58] Field of Search ..... 383/121.1, 119; 206/386

[56] References Cited

U.S. PATENT DOCUMENTS

| | | | |
|---|---|---|---|
| 1,148,948 | 8/1915 | Benjamin | 206/386 |
| 1,148,949 | 8/1915 | Benjamin | 206/386 |
| 2,415,956 | 2/1947 | Mamaux | 383/121.1 |
| 3,295,738 | 1/1967 | Keuchenius et al. | 206/386 |
| 3,425,472 | 2/1969 | Marino | 383/121.1 |
| 4,830,191 | 5/1989 | Dijksman | 206/386 |
| 5,025,925 | 6/1991 | Wiklund | 206/386 |
| 5,316,387 | 5/1994 | Polett et al. | 383/119 |
| 5,328,268 | 7/1994 | Lafleur | 383/119 |
| 5,468,528 | 11/1995 | Schnaars et al. | 383/119 |
| 5,538,155 | 7/1996 | Hoekstra | 383/119 |

FOREIGN PATENT DOCUMENTS

| | | | |
|---|---|---|---|
| 82110434 | 11/1982 | European Pat. Off. | B65D 88/16 |
| 94309073 | 12/1994 | European Pat. Off. | B65D 88/16 |
| 3928054 | 2/1991 | Germany | 206/386 |
| 2161452 | 1/1986 | United Kingdom | B65D 88/16 |
| 2255963 | 11/1992 | United Kingdom | B65D 88/16 |
| WO 92/13781 | 8/1992 | WIPO | 206/386 |

*Primary Examiner*—Stephen P. Garbe
*Attorney, Agent, or Firm*—Fields & Johnson, P.C.

[57] ABSTRACT

A bulk bag is provided which includes a base for cooperating with a forklift to allow transportation of the bag, and has a plurality of side walls extending upwardly from the base to collectively define a space for receiving bulk material. The base includes two spaced apart substantially horizontal engagement members for abutting support by respective forks or tines of the forklift and a reinforced cavity disposed between and downwardly extending from the engagement members for providing structural support to the bag. Reinforcing members extend across the inside of the bag from wall to wall adjacent the base. In one embodiment, the reinforcing members have openings to allow the bulk material to pass therethrough so that the reinforcing members become embedded therein and are under tension to maintain the bag in a desired configuration when filled. Alternatively, a plurality of reinforcing members, in the form of strips, are spaced apart and extend between the base walls within the bag. The bulk material can pass between the strips during filling so that they become embedded in the bulk material and are placed in tension to retain the bag in a substantially desired configuration.

12 Claims, 3 Drawing Sheets

FLEXIBLE BULK BAG WITH IMPROVED BASE

TECHNICAL FIELD

This invention relates to a flexible bulk bag having longitudinal recesses at the outer part of its bottom for fitting to the forks or tines of a forklift so that a protruding portion of the bottom is formed between the recesses.

BACKGROUND ART

Such a bulk bag is described in European Patent Application EP 665175 A1. It has external reinforcing members on the recesses. Such reinforcement must be very stiff in order to prevent the recesses from bulging out.

The invention has been developed primarily for transporting bulk material, for example, cement, plastic, grains or the like, and will be described hereinafter with reference to that application. However, it will be appreciated that it is also suitable for transporting other materials such as grain, dust, powder or pellets.

DISCLOSURE OF THE INVENTION

It is an object of the present invention, at least in the preferred embodiment, to overcome or substantially ameliorate this disadvantage of the prior art.

It is an object of the invention to provide for a bulk bag of this kind which has no stiff reinforcement, but is completely flexible so that, when empty, it can be folded together completely and take up a minimum of space. Still, it should be possible to lift the bulk bag by directly engaging the forks or tines of a fork lift with the bulk bag so that it will not be necessary to use a pallet. This objective is accomplished by means of flexible stiffening elements or strips inside the bulk bag.

According to the invention there is provided a bulk bag including a base for cooperating with a forklift to allow transportation of the bag, and a plurality of walls extending upwardly from the base to collectively define a load space, wherein the base, in use, includes two spaced apart substantially horizontal engagement members for abutting support by respective forks or tines of the forklift and a reinforced cavity disposed between and downwardly extending from the engagement members for providing structural support to the bag.

The cavity includes at least one reinforcing member. In one preferred embodiment, the reinforcing member extends between the respective upper edges of the base walls. More preferably, the member includes a plurality of openings between the load space and the cavity.

In other embodiments, the reinforcing members extend from respective upper edges of the base wall to the base portion. Alternatively, a first set of the reinforcing members are spaced apart and extend between the upper edge of one of the base walls and the lower edge of the other base wall, while a second set of the reinforcing members are spaced apart and extend between the upper edge of the other base wall and the lower edge of the said one of the base walls. Most preferably, members of the first and second set are alternately spaced.

In further alternative embodiments, reinforcing members extend between the opposed base walls.

Additional advantages of this invention will become apparent from the description that follows, taken in conjunction with the accompanying drawings.

BEST MODE FOR CARRYING OUT THE INVENTION

Figure 1:
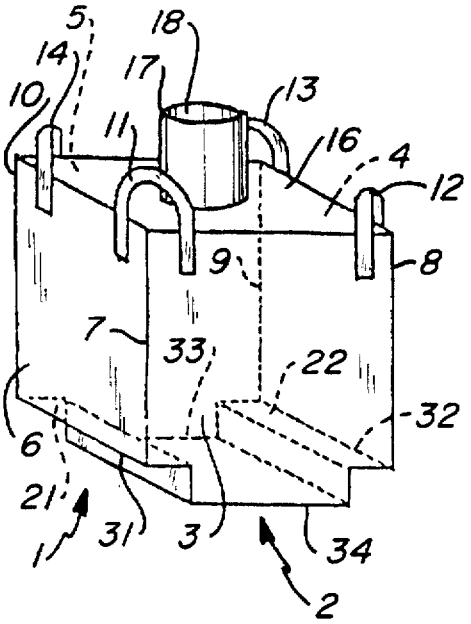
FIG. 1 is a perspective view of a bulk bag according to the invention omitting any reinforcing members.
Figure 2:
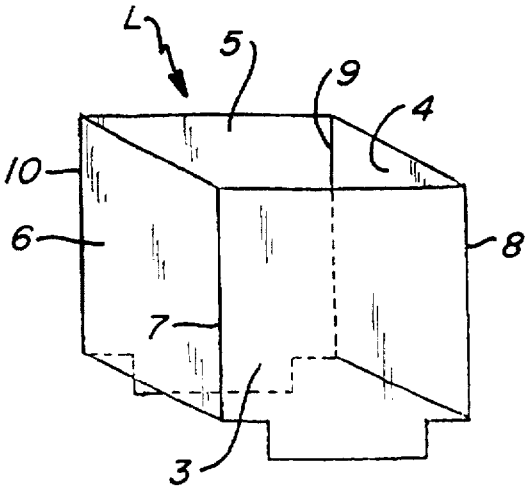
FIG. 2 is a perspective view of the walls of the bag of FIG. 1.
Figure 3:
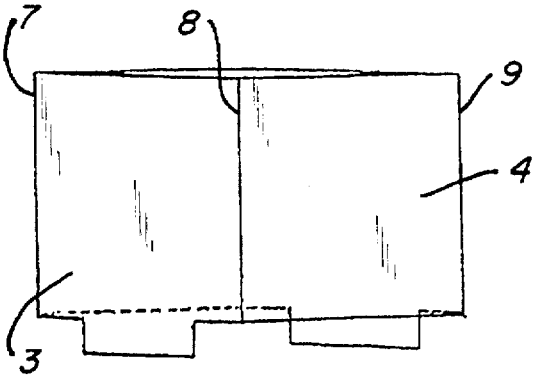
FIG. 3 is another perspective view of the walls of the bag of FIG. 1.

Referring to FIG. 1, a bulk bag 1 includes a base 2 and four upwardly extending side walls 3, 4, 5 and 6 which are connected to adjacent walls by seams 7, 8, 9 and 10 for defining a load space L. Bag 1 includes four loops 11, 12, 13 and 14 which extend between respective adjacent walls to facilitate handling of bag 1.

Bag 1 also includes a top 16 having a chute 17 defining an opening 18 for allowing passage of material into load space L. In alternative embodiments, bag 1 includes an open top.

Preferably, bag 1 to include each of its structural components is produced from woven polypropylene fabric and is essentially self-supporting. The fabric can be coated with polypropylene, if required. Other embodiments are made from alternative materials, as would be known to those of ordinary skill in the art.

The stitching between adjacent components of bag 1 is preferably polypropylene, although nylon or polyester stitching is also suitable. The components also may be attached by a suitable adhesive or by heat sealing.

Figure 4:
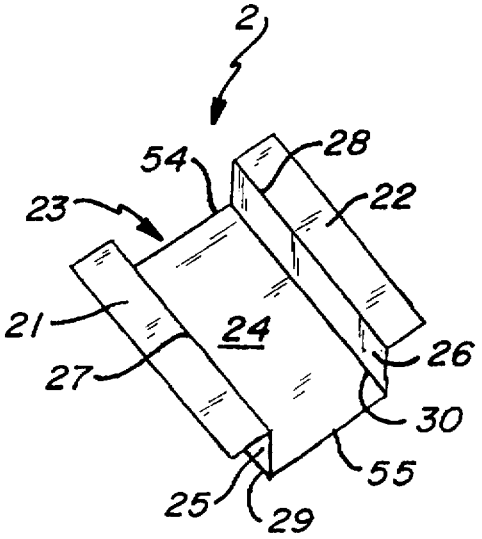
FIG. 4 is a perspective view of the base detached from the side walls and, omitting any reinforcing members.

Base 2, as best shown in FIG. 4, includes two opposed substantially horizontal engagement members 21 and 22 for support by abutting respective tines of a forklift. Base 2 further includes base portion 24 and opposed base walls 25 and 26 A cavity 23 is disposed between and downwardly extends from members 21 and 22. This cavity includes reinforcing members which are under tension when the bag is filled for providing structural support to the bag. When filled, these stiffening or reinforcing members are completely covered or embedded in the contents of the bag. A number of alternative reinforcing members are contemplated by the invention, as will be exemplified by the following description. In all the illustrated embodiments, cavity 23 is defined by the substantially planar base portion 24 and two opposed base side walls 25 and 26. Walls 25 and 26 extend between respective top edges 27 and 28 to respective lower edges 29 and 30. As shown in FIG. 1, base 2 attaches to the side walls 3, 4, 5 and 6. That is, horizontal engagement members 21 and 22 attach to side walls 6 and 4 along seams 31 and 32, respectively. Similarly, exposed ends 54 and 55 of base portion 24 (see FIG. 4) attach to side walls 5 and 3 along seams 33 and 34, respectively.

Figure 5:
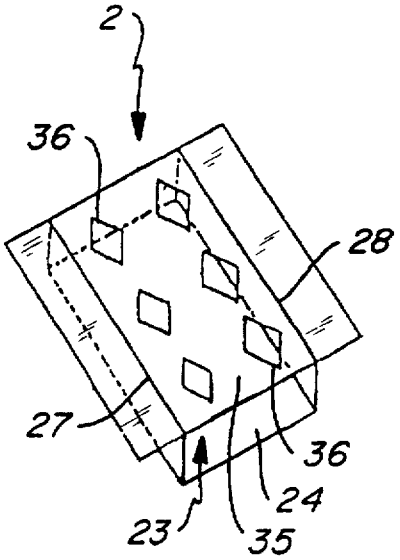
FIG. 5 is a perspective view of the base of FIG. 4 including one form of reinforcing member.

A first reinforcing member configuration is illustrated in FIG. 5 where a single rectangular member, such as sheet 35, is attached to and extends horizontally between opposed top edges 27 and 28. Sheet 35 includes an array of spaced apart apertures 36 for allowing passage of the material contained within the load space L into cavity 23 so that sheet 35 is completely embedded in the bulk material. The sheet 35 will thus be tension loaded so that it stabilizes in this rectangular form when the bulk bag is filled with bulk goods. Thus, the bulk bag can be lifted by the forks or tines of a fork lift as an alternative to being lifted by its lift loops.

Figure 6:
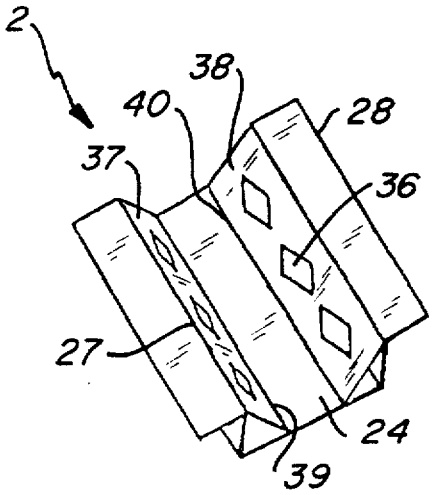
FIG. 6 is a perspective view of the base of FIG. 4 including a second form of reinforcing member.

Referring to FIG. 6, another embodiment of the invention includes two opposed reinforcing members such as strips or sheets 37 and 38. These members extend downwardly from respective top edges 27 and 28 to base portion 24, where they are fixedly connected along seams 39 and 40. These two sheets 37 and 38 also have holes 36 so that the sheets are embedded by the bulk material when the bag is filled.

Figure 7:
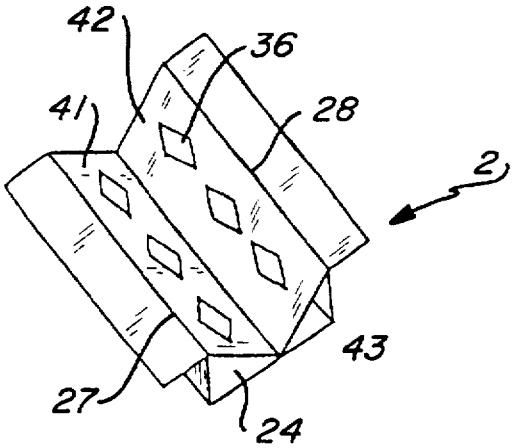
FIG. 7 is a perspective view of the base of FIG. 4 including a third form of reinforcing member.

FIG. 7 illustrates a variation of the embodiment of FIG. 6. More particularly, the two reinforcing members, such as strips or sheets 41 and 42, have a plurality of openings 36 and coterminate at their lower edges in a common seam 43. When filled with bulk material, members 41 and 42 are in tension and help maintain the shape of the bag.

Figure 8:
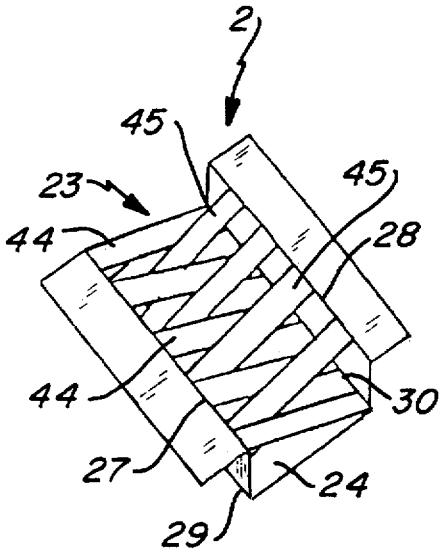
FIG. 8 is a perspective view of the base of FIG. 4 including a fourth form of reinforcing member.

The embodiment of the invention illustrated in FIG. 8 includes two sets of reinforcing members, such as strips 44 and 45, wherein a first set of strips 44 extend from top edge 27 to lower edge 30. The reinforcing strips 45 of the second set, however, are alternately disposed between the reinforcing strips 44 of the first set and extend between top edge 28, and lower edge 29. All these strips will also be embedded in the bulk material and be under tension when the bag is filled. From the emptying point of view, separate strips with openings between them are better than sheets with holes in them. The embodiments of FIGS. 5–7 can be modified to comprise longitudinal or lateral strips instead of the single sheet 35. Then, there can be a distance between adjacent strips to allow the bulk material to cover or embed the strips.

The embodiments of the invention, illustrated in FIG. 9 through 12, all include substantially vertical reinforcing members. More particularly, the embodiment of FIG. 9 includes three reinforcing members 46, 47 and 48. Member 46 includes two opposed broad sides 46*a* (only one shown). This member engages at base wall 25 and at base wall 26. Those ends are fixedly attached to the respective adjacent base walls 25 and 26, while the lower edge is attached to base portion 24. This ensures that broad sides 46a are maintained in a tensioned and substantially planar when bulk material is in the bag. Members 47 and 48 are similarly attached about their lower edges and ends, although their orientation is angularly displaced from that or member 46.

Figure 9:
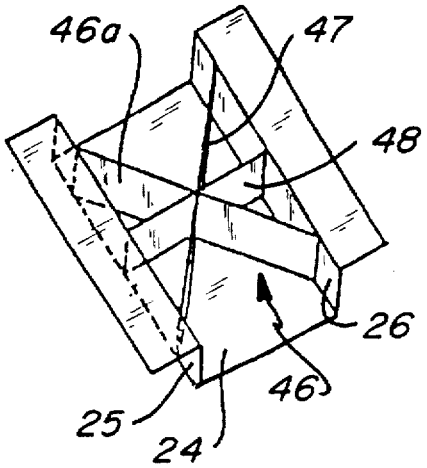
FIG. 9 is a perspective view of the base of FIG. 4 including a fifth form of reinforcing member.
Figure 10:
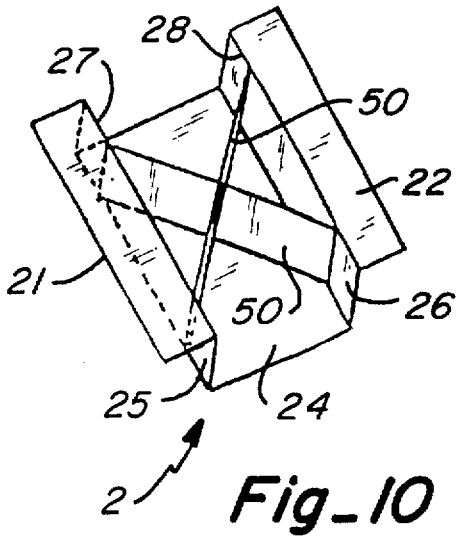
FIG. 10 is a perspective view of the base of FIG. 4 including a sixth form of reinforcing member.
Figure 11:
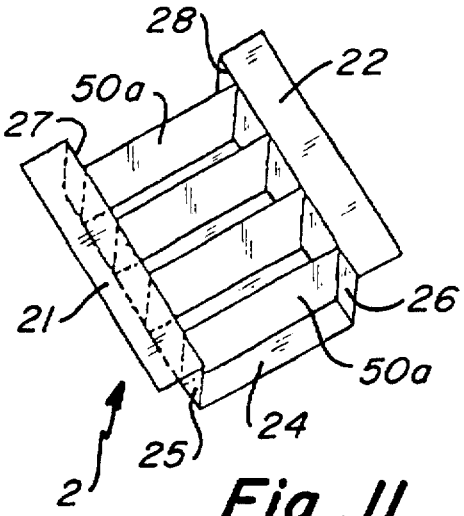
FIG. 11 is a perspective view of the base of FIG. 4 including a seventh form of reinforcing member.
Figure 12:
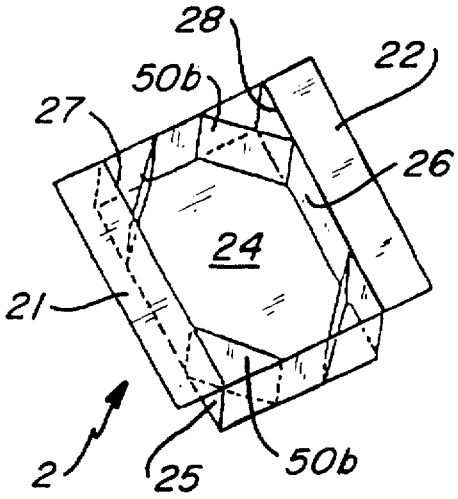
FIG. 12 is a perspective view of the base of FIG. 4 including an eighth form of reinforcing member.

The reinforcing members, such as strips 50, 50a and 50*b* in FIGS. 10, 11 and 12, respectively, are configured differently to those of FIG. 9. However, in all cases, the reinforcing members are attached to the adjacent base walls and base portion and are in tension when the bag is filled to provide structural support to base 2, and, consequently, to bag 1.

In all the alternative embodiments shown, the stiffening and stabilizing sheets or strips are arranged symmetrically and are arranged to be embedded in the bulk material when the bag is filled. They will be tension loaded by the bulk material and will maintain the form of the base wall 25 and 26. The stabilizing sheets or strips preferably can be made of the same material as the entire bag.

A bulk bag constructed in accordance with the invention can be easily transported in a flat folded condition prior to filling but, after filling, can be transported with a forklift and/or crane or the like. The bag walls will retain their shape even after repeated handling due to the tension placed on the internal sheets or strips when the bag is filled.

The invention facilitates the speedy transfer of the bags between modes of transportation, for example, between ships and land-based transport and vice versa.

In the preferred embodiment, the bag includes a substantially square horizontal cross section. In some alternative embodiments, the horizontal cross section is rectangular, while other embodiments utilize different shapes.

Although the invention has been described with reference to a particular example, it will be appreciated by those skilled in the art that it may be embodied in many other forms.

What is claimed is:

1. A flexible bag for storing bulk materials which can be transported by being supported on spaced tines of a forklift and having a predetermined shape when filled, said bag comprising:

a base having a base portion and a pair of base walls attached on opposite ends of said base portion, said base further including spaced longitudinal engagement members for receiving the fork tines of the fork lift thereunder, each of said spaced longitudinal members being attached to a corresponding one of said pair of base walls, said base walls extending below a level at which the tines engage the longitudinal engagement members;

at least a first side wall and a second side wall attached to and extending upward from said base, said side walls forming a space to be filled with the bulk material above the level of the tines, and said side walls and said base walls forming a second space contiguous with said first space, said second space positioned below the level of the tines and also to be filled with bulk material; and at least one flexible stiffening member within said bag extending between said base walls, said at least one flexible stiffening member having first and second ends, said first end being attached to one wall of said pair of base walls and said second end being attached to the other wall of said pair of base walls so that said at least one flexible stiffening member is in tension when said bag is filled with bulk material to substantially hold said bag in said predetermined shape.

2. An apparatus, as claimed in claim 1, wherein said at least one flexible stiffening member includes:

at least two stiffening members.

3. An apparatus, as claimed in claim 1, wherein:

said at least one flexible stiffening member has at least one opening formed therein through which the bulk material may pass.

4. An apparatus, as claimed in claim 1, wherein:

said at least one flexible stiffening member is located adjacent said rigid base.

5. An apparatus, as claimed in claim 4, wherein:

said at least one flexible stiffening member is embedded in the bulk material when the bag is filled.

6. A flexible bag for storing bulk materials which can be transported by being supported on spaced tines of a forklift and having a predetermined shape when filled, said bag comprising:

a base including a pair of base walls and a pair of spaced longitudinal members, each member being attached to a corresponding one of said base walls;

a first pair of opposed side walls attached to and extending upward from said base;

a second pair of opposed side walls vertically attached to said first pair of said side walls and further attached to and extending upward from said base, said first pair of opposed side walls and said second pair of opposed side walls forming an open space for holding the bulk material; and at least one flexible stiffening member within said bag, said at least one flexible stiffening member having first and second ends, said first end being connected to one base wall of said pair of base walls and said second end being connected to the other base wall of said pair of base walls.

7. An apparatus, as claimed in claim 6, wherein:

said at least one flexible stiffening member has at least one opening formed therein through which the bulk material may pass.

8. An apparatus, as claimed in claim 6, wherein said at least one flexible stiffening member includes:

at least two flexible stiffening members.

9. An apparatus, as claimed in claim 8, wherein:

said at least two flexible stiffening members each have first and second ends connected respectively to one base wall of said pair of base walls and to the other base wall of said pair of base walls.

10. An apparatus, as claimed in claim 8, wherein:

said at least two flexible stiffening members include a first set of parallel strips spaced laterally from one another and positioned at an inclined angle, and a second set of parallel strips interspersed between said first set of parallel strips and positioned at an opposite inclined angle.

11. An apparatus, as claimed in claim 9, wherein:

said at least two flexible stiffening members intersect each other intermediate said respective first and second ends.

12. An apparatus, as claimed in claim 8, wherein:

said at least two flexible stiffening members are parallel to each other.

* * * * *